United States Patent [19]

Laboureau

[11] Patent Number: 4,836,298

[45] Date of Patent: Jun. 6, 1989

[54] BOAT OF THE CATAMARAN TYPE, PROPELLED MECHANICALLY

[76] Inventor: Jacques-Philippe Laboureau, 24, rue de la Fontainer Billenois, 21000 Dijon, France

[21] Appl. No.: 150,399

[22] Filed: Jan. 29, 1988

[30] Foreign Application Priority Data

Jan. 30, 1987 [FR] France ..... 87 01156

[51] Int. Cl.[4] ..... B63B 1/12

[52] U.S. Cl. ..... 114/61; 114/283; 114/352; 248/640

[58] Field of Search ..... 114/61, 270, 344, 352, 114/283, 292; 440/900; 248/640

[56] References Cited

U.S. PATENT DOCUMENTS

| | | | |
|---|---|---|---|
| 2,748,740 | 6/1956 | Villar | 114/61 |
| 2,840,832 | 7/1958 | Fried | 114/270 |
| 3,125,982 | 3/1964 | Mullenax | 114/270 |
| 3,442,246 | 5/1969 | Paolone | 114/270 |
| 3,483,844 | 12/1969 | Trautwein | 114/270 |
| 3,968,532 | 7/1976 | Bailey | 114/61 |

FOREIGN PATENT DOCUMENTS

| | | | |
|---|---|---|---|
| 2735345 | 2/1979 | Fed. Rep. of Germany | 114/61 |
| 3523124 | 1/1987 | Fed. Rep. of Germany | 114/61 |
| 2437343 | 5/1980 | France | 114/61 |
| 7508090 | 1/1977 | Netherlands | 114/61 |

*Primary Examiner*—Sherman D. Basinger
*Assistant Examiner*—Thomas J. Brahan
*Attorney, Agent, or Firm*—McAulay Fisher Nissen & Goldberg

[57] ABSTRACT

A boat of the catamaran type, which is mechanically propelled, preferably by means of an outboard motor comprises two floasts, which are advantageously identical, coplanar and parallel, and a seat of the motor which are maintained rigidly together.

Two transverse bars are disposed, perpendicularly to the axis of the floats, and central longitudinal member extending longitudinally between the two floats to connect the two transverse bars, at their center. Two lateral bows are fast with the seat and extend on either side thereof, up to the front transverse bar lower and upper fairings completing the boat by constituting a place to sit and for control.

20 Claims, 5 Drawing Sheets

39
34
38
39
37
15
35
2
9
31
1
32
29
37
36
4
7
6
27
14
11
33
28
263
30
16
39
19
7
6
3
24
18
26
261
17
19
9
4
262
39
6
25
7

26
263
263
261
262
25
39
24
9
5
23
16
17
21
28
3
39
25
22
9
5
37
5
9
14
29
15
2
37
5
9
31
27
30

BOAT OF THE CATAMARAN TYPE, PROPELLED MECHANICALLY

BACKGROUND OF THE DESCRIPTION

The present invention relates to a boat of the catamaran type, propelled mechanically, preferably with an outboard motor, which is light, uncapsizable, non-sinkable and entirely dismountable.

Numerous boats are known which comprise in tandem two floats connected by assembly means which are either rudimentary if a supple connection is desired, and in that case high speed is excluded, or very complex if a considerable rigidity is desired. Mechanically propelled catamarans are included in the latter case, of which the weight is further increased by the reinforcing elements for the motor support. This type of boat is therefore not propicious for frequent dismantlings by nonspecialized users. In addition, other conventional problems result from such boats, such as the weight which renders manipulations and transport difficult and increases the draught, therefore the power of propulsion and consequently the investment and exploitation costs.

SUMMARY OF THE INVENTION

All these drawbacks are largely eliminated by the invention which relates to a boat of the catamaran type, which is mechanically propelled, preferably by means of an outboard motor, characterized in that the two floats, which are advantageously identical, coplanar and parallel, and the seat of the motor are maintained rigidily together by assembly means comprising:

two tranverse bars disposed, perpendicularly to the axis of the floats, substantially at the front of the latter for one and at the rear for the other and fast with the floats in a dismountable manner by fitting in slots;

a central longitudinal member extending longitudinally between the two floats, preferably at equal distance therefrom, to connect the two transverse bars, at their centre, by suitable, dismountable fixing means so that the rear transverse bar is thus blocked in rotation in order to be able to support the seat of the motor, including when said bearing is offset rearwardly;

two lateral bows fast with the seat and extending on either side thereof, in an appropriate profile, up to the front transverse bar on which they are fixed in order to absorb the efforts of acceleration and to constitute a member for the passenger to hold, and lower and upper fairings completing the boat by constituting a place to sit and for control.

Numerous advantages follow from such an embodiment, and in particular a reduction in the weight of the boat in a ratio that may attain 3 in comparison with conventional boats of the same type. This characteristic is obtained thanks to the simplification of the device for connecting the two floats which is strictly limited to two transverse bars joining the two floats, blocked in rotation about their axis by the central longitudinal element which contributes in addition to the reinforcement of the boat subjected to the longitudinal advance forces due to propulsion. Preferably constructed from stainless steel tubing, the connecting cradle is lightened, with the result that the boat with its motor and equipment presents a particularly reduced draught allowing a low power of the motor to take said boat to speeds comparable with conventional boats for pulling a water-skier. It is therefore easy to understand the decisive economic advantages of the invention since it requires reduced power, therefore much reduced investment to which is added a saving of fuel.

The means for fixing the floats and the transverse bars which have been retained are constituted by transverse bars, of length substantially identical to the overall width of the catamaran, fitting in slots which extend transversely to the front and rear of each float, on their upper surfaces, in accordance with the teachings of Applicants' European Pat. No. 84 400 754.2. These slots which have a sufficient section to fit any thickness of the bars, present a shape following the exact shape of said bars. At each end of the bars, a vertical centering stud fast with said bars, predispose the two floats colinearly in rapid and reliable manner; a simple bolting on either side of the centering stud fixes each bar to the floats. In this way, the floats have no degree of freedom in their reciprocal movements, thus ensuring total rigidity of the whole, which is necessary having regard to the speeds that this type of boat may attain.

Nonetheless, it will be observed that the tapped holes provided in the bottom of each slot in the floats are obtained by embedding in the material constituting said floats, a metal insert taking the shape of said floats and presenting in its lower part an orifice adapted to receive the central stud of the transverse bars on either side of which extend two internally tapped vertical cylinders fixed to said insert at the level of the fixing holes provided to that end at each end of the transverse bars. This rigid assembly of the floats now being ensured, the central longitudinal element is placed in position by simple fitting on horizontal studs fast with the rear transverse bar after having traversed by sliding the front transverse bar by means of a bore provided to that end at the centre of said bar. The rear bar which is thus blocked in rotation by the central longitudinal element may receive the cradle for fixing the motor, preferably of the outboard type, this cradle being able to be at the level of the rear bar or offset rearwardly, thanks to a conventional triangulation abutting on the same rear bar. Cooperating in the rigidification of the whole system of assembly described hereinabove, two longitudinal bows are provided at the level of the axis of the floats; to that end, these bows join the cradle for fixing the motor to the transverse bar in a profile comprising curved sections giving the bows a certain longitudinal suppleness, performing the role of damper with respect to the effects of shocks and sudden acceleration; the curved forms of said damper bracing are unexpectedly and advantageously used to provide on the boat rails for the passengers to hold in safety.

Lower and upper fairing means advantageously complete the framework which has just been described, particularly for creating upper structures suitable for each user to sit and control the boat.

Thus defined, the boat according to the invention presents the advantage of being completely dismountable without resorting to specialists, which may be a solution to many a problem of handling, transport or care-taking.

In accordance with a complementary feature of the invention, floats are preferably used whose transverse section is rounded, thus differing from the known "V"-sections of the majority of catamarans.

This particular geometry of the floats which are encountered especially in wind-surfers, presents the advantage of reducing not only the resistance to advance but also the resistance of the boat to the lateral efforts due to the centrifugal force, thus causing veritable skids in sharp bends, are consequently avoiding any risk of capsizing the catamaran.

Furthermore, this type of float is well adapted to landing, this increasing the comfort of suche boats.

BRIEF DESCRIPTION OF THE DRAWINGS

One embodiment of the present invention will be described hereafter by way of non limitative example with reference to the accompanying drawings in which.

DESCRIPTION OF THE PREFERRED EMBODIMENT

Figure 1:
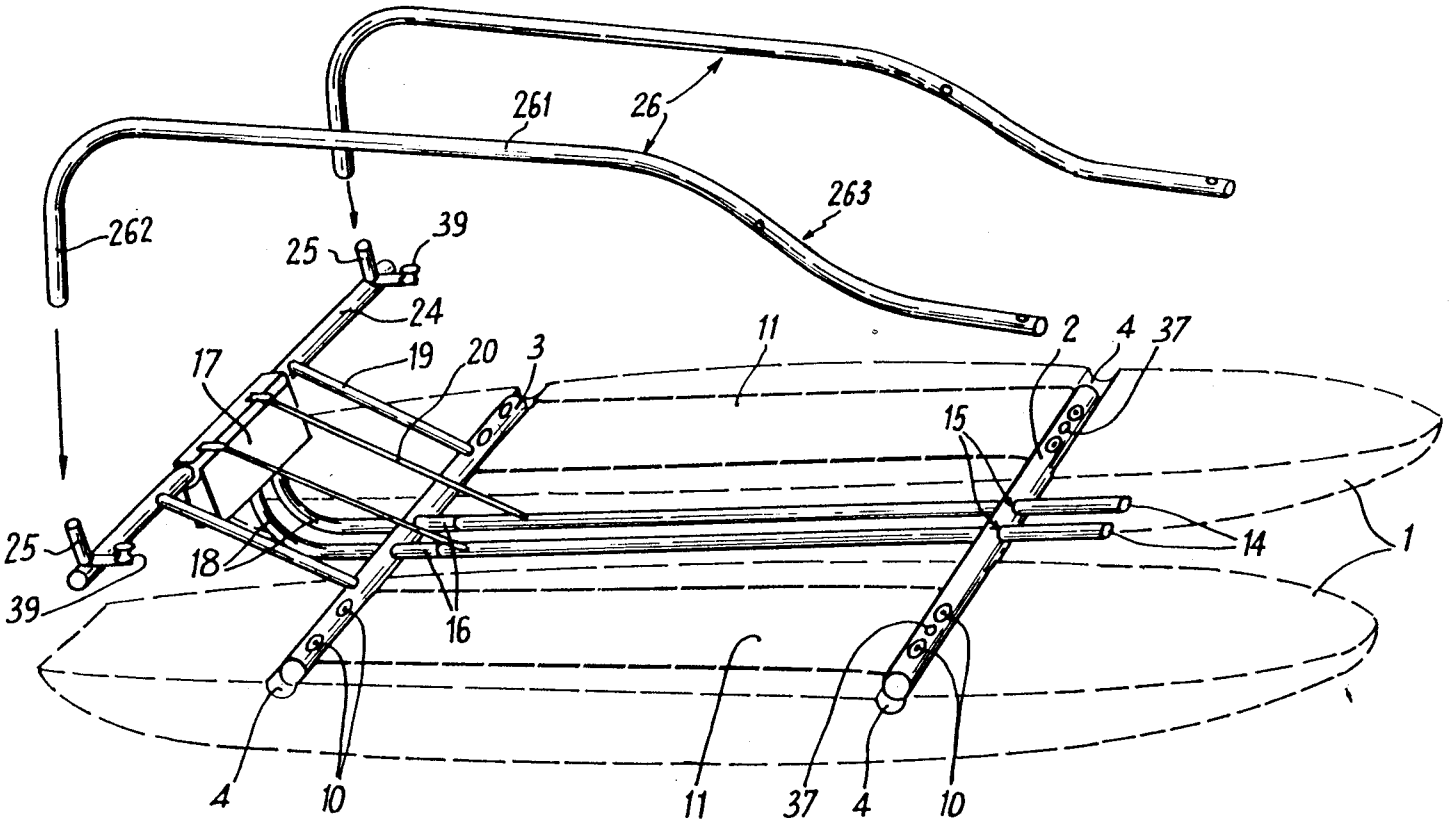
FIG. 1 is a view in perspective of the cradle of the boat according to a principal variant of the seat of the motor.
Figure 2:
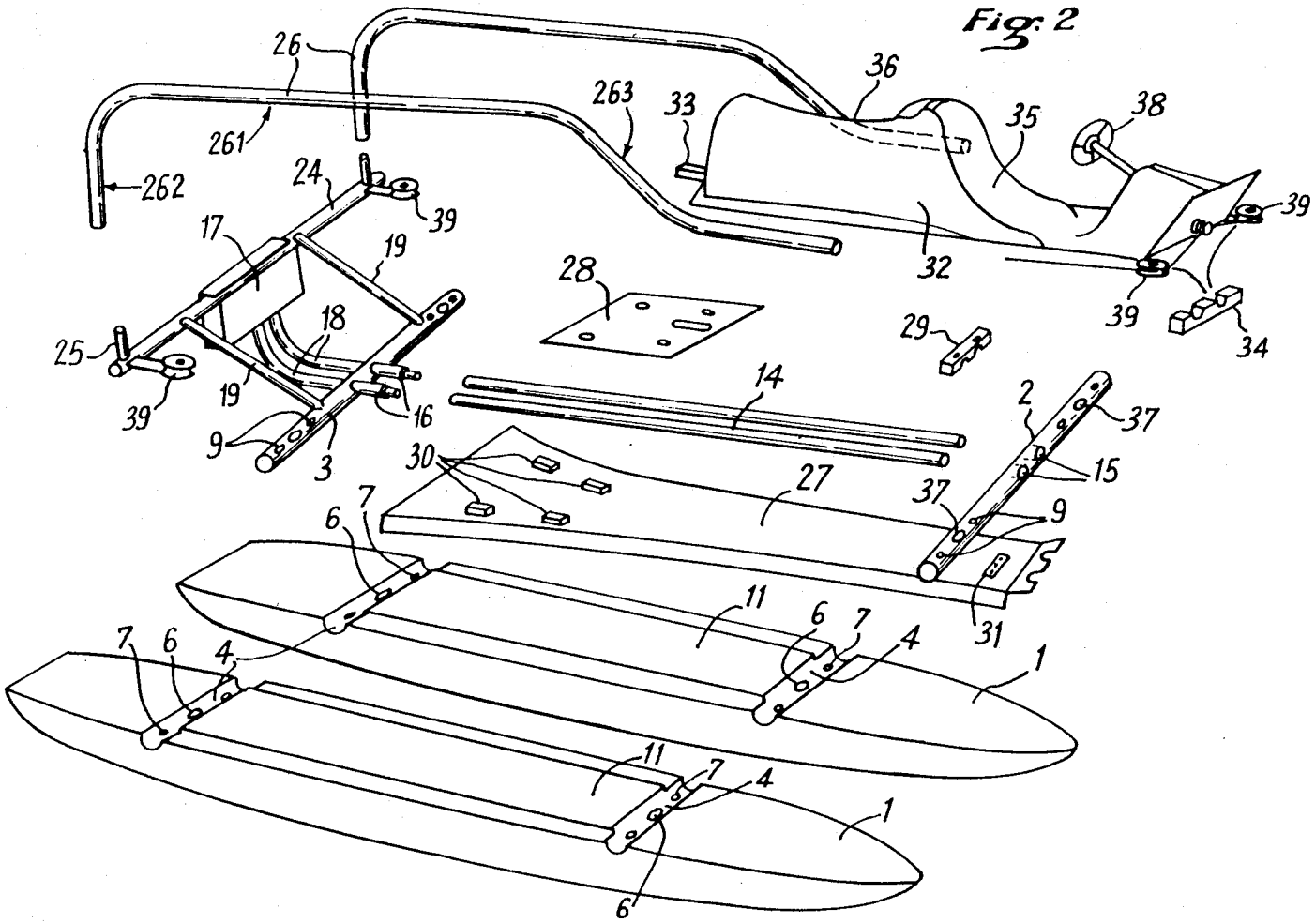
FIG. 2 is an exploded view in perspective of the boat according to the invention, the principal parts being shown in a relative position of assembly.
Figure 3:
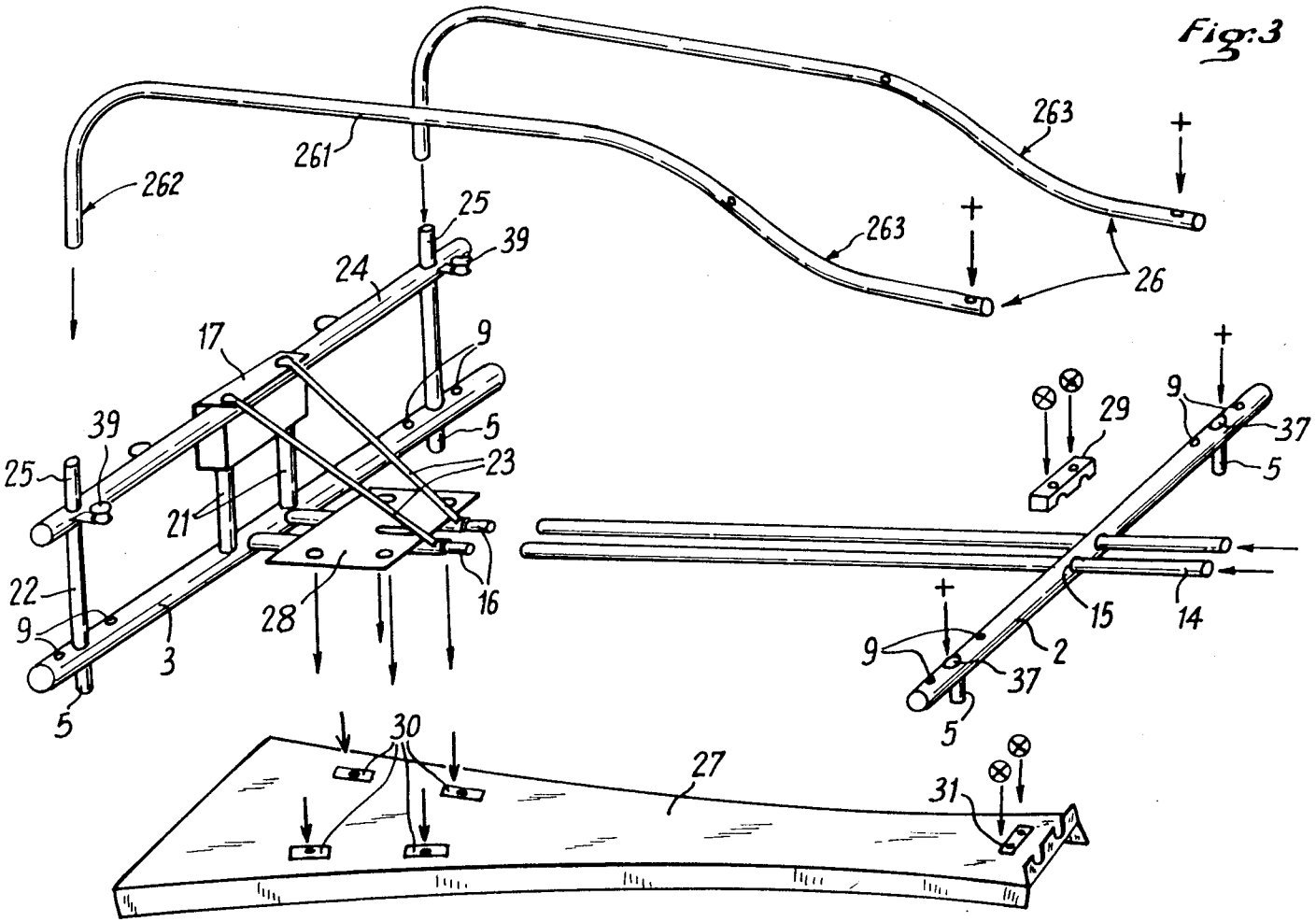
FIG. 3 is an exploded view in perspective of the cradle of the boat according to another variant of the seat of the motor.

Referring now to the drawings, and firstly to FIGS. 1 to 3, the boat shown by way of example, according to the invention, is composed of two identical floats 1 made of a moulded material, preferably glass-fiber reinforced synthetic resin, maintained parallel, side by side, in the same horizontal plane. The floats are maintained in this way thanks to a preferably tubular assembly made of stainless steel comprising, on the one hand, transverse connecting means and, on the other hand, longitudinal reinforcing and blocking means. To that end, a first transverse bar 2, of round section and of sufficient diameter having regard to the mechanical stresses, ensure connection of the floats 1 in their front part and a second transverse bar 3, of the same section as the first, connects the rear parts of the floasts 1. These bars 2 and 3 are fitted in slots 4 of depth at least equal to the section of said bars, which are formed on the upper surfaces of the floats 1 during moulding thereof and which extend transversely over the whole width of the floats 1.

Figure 4:
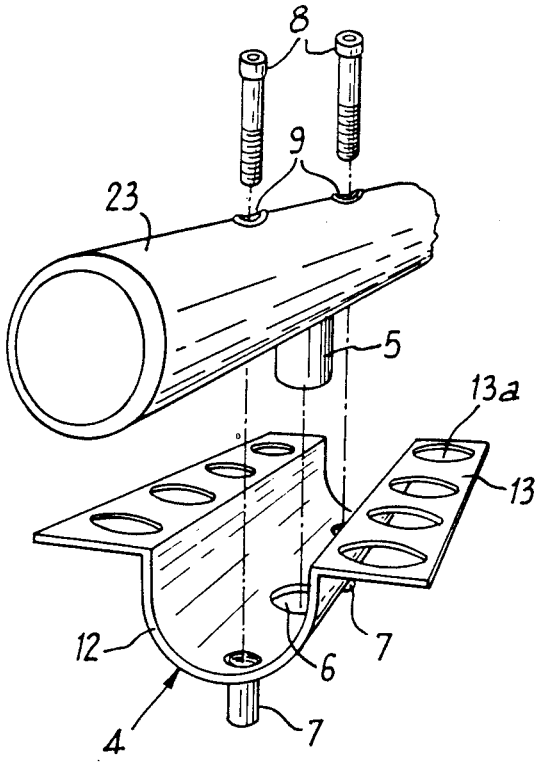
FIG. 4 is an exploded view in perspective of a transverse bar and of an insert in the forom of a gutter embedded in the material of the floats.
Figure 5:
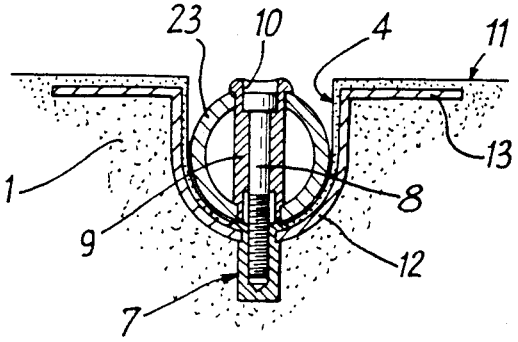
FIG. 5 is a view in transverse section showing a bar housed in its slot and bolted in the embedded insert.

In accordance with FIG. 4, each end of the bars 2 and 3 is provided with a centering stud 5 fixed vertically in known manner beneath said bars 2 and 3 at the level of the median axis of each float 1 to fit in an orifice 6 made in the bottom of the slots 4 so as rapidly to obtain a reliable and predetermined transverse assembly. At the bottom, said slots 4 comprise, along their longitudinal axis, two tapped wells 7 disposed on either side of the centering orifice 6 to receive bolts 8 for fixing the bars 2 and 3 in accordance with FIG. 5. The bolts 8 traverse the bars 2 and 3 pierced to that end with smooth holes 9 each comprising, in its upper part, a countersink 10 adapted to countersink the hollow six-sided heads of the bolts 8, so that they constitute no superficial obstacle on the upper bridges 11 of the floats 1.

According to a particular arrangement retained for the invention, metal inserts 12, of omega cross-section, following the shape of the slot in their central part, having for effect to position the centering orifice 6 and to hold the tapped wells 7 by rendering them fast with the hull of floats 1, are embedded in the material constituting the floats 1. According to FIGS. 4 and 5, each insert 12 is provided, in its upper part, with horizontal flanges 13 embedded transversely beneath the upper face 11 of the floats 1. These flanges 12 advantageously comprise holes **13*a* reinforcing cohesion of the insert 12 in the slot 4**.

Cooperating with these transverse connecting means, longitudinal means complete the assembly cradle of the boat according to the invention. To that end, a central longitudinal element 14, preferably constituted by two identical bars, of diameter substantially less than that of the transverse bars 2 and 3, made of stainless steel tubing, joins the transverse bars 2 and 3 in their central parts and thus blocks any possibility of axial rotation of the bars 2 and 3. Furthermore, the central longitudinal element 14, participating in the holding of the propelling member as will be set forth hereinbelow, longitudinally distributes the efforts of thrust and of resistance of the boat transmitted to the floats thanks to the transverse connecting bars 2 and 3 and to the slots asociated therewith.

So as to facilitate successive assemblies and dismantlings, the bars forming the central longitudinal member 14 are mounted in a horizontal plane, at the centre of the front transverse bar 2 and pependicularly thereto, by means of two horizontal diametral bores 15 in the bar 2 through which they slide to fit on two longitudinal studs 16, extending forwardly and fast with the central part of the rear transverse bar 3 which consequently loses all possibility of rotation on its axis. Consequently, it becomes possible to fix the seat 17 of the motor on the rear transverse bar 3 whether it is rearwardly offset as in FIGS. 1 and 2, or, according to a secondary variant shown in FIG. 3, is plumb with said bar 3. In the first variant, the seat 17 is supported by two tubes 18 fast with the bar 3 and advantageously disposed in line with the central bars 14 which particularly compensate the efforts of couple resulting from the assembly, completed in this sense by a double triangulation 19 and 20 conventionally joining the upper edge of the seat 17 to the bar 3, on the one hand, and to the central bars 14, on the other hand. In the secondary variant (FIG. 3), the seat 17 is connected to the bar 3 by two sets of vertical uprights 21 and 22 triangulated in conventional manner by arms 23 abutting on the longitudinal elements 14, and fixed by conventional means.

Borne at the ends of a horizontal and transverse bar 24, fast with the seat 17, of the same length as the bars 2 and 3, two vertical studs 25 cooperate, by fitting, in the rear fixation of lateral bows 26 contributing to the reinforcement of the assembly and for the passengers to hold. Front fixation of these bows 26 is obtained by specific screwing on the centering stud 6 of the bar 2 here participating in the control of the axial rotations. Furthermore, the bows 26, preferably made of stainless steel, have an appropriate longitudinal section. A first horizontal intermediate section 261 serves for transmitting the longitudinal stresses and advantageously as rail for the passengers to hold. A second rear section 262, vertical, comprises means for rear fixation of the bows 26 on the studs 25 fast with the seat 17. A third front section 263, of curved form, provides the bows 26 with their elasticity of deformation to the transitory stresses and accessorily a lateral clearance to facilitate access to the control station of the boat.

According to another feature of the invention, a first lower fairing 27, constituted by a plate of material of the same type as that of float 1, abuts on and follows the shape of the inner lateral faces of said floats, consequently obturating the intermediate space between floats 1. This fairing 27 is mounted beneath the boat be means of two counter-plates 28 and 29 which tighten the fairing 27, at the front and at the rear, on the central bars 14, by simple screwing at 30 and 31.

A second upper fairing 32 fits on the lower fairing 27 at the centre of the catamaran, to which it is fixed at the rear by a lug 33 bolted to the counter-plate 28 and, at the front, by an element 34 identical to counterplate 29, tightening the fairing 32 at the front end of the central longitudinal member 14.

This upper fairing 32, of appropriate one-piece form, comprises specific and known means for controlling the propelling member, such as throttle control lever and steering wheel 38 connected in conventional manner by cables and pulleys 39 to the outboard motor of which the horizontal rotation determines the direction of the boat. This same upper fairing 32 presents at its centre a recess 35 advantageously in the form of a driving seat and a rear part having the general form of a saddle for a passenger to sit astride, the two lateral bows 26 contributing to holding this passenger safely.

A complementary feature of the invention follows from the type and shape of the floats 1 with which the boat is equipped.

Figure 6:
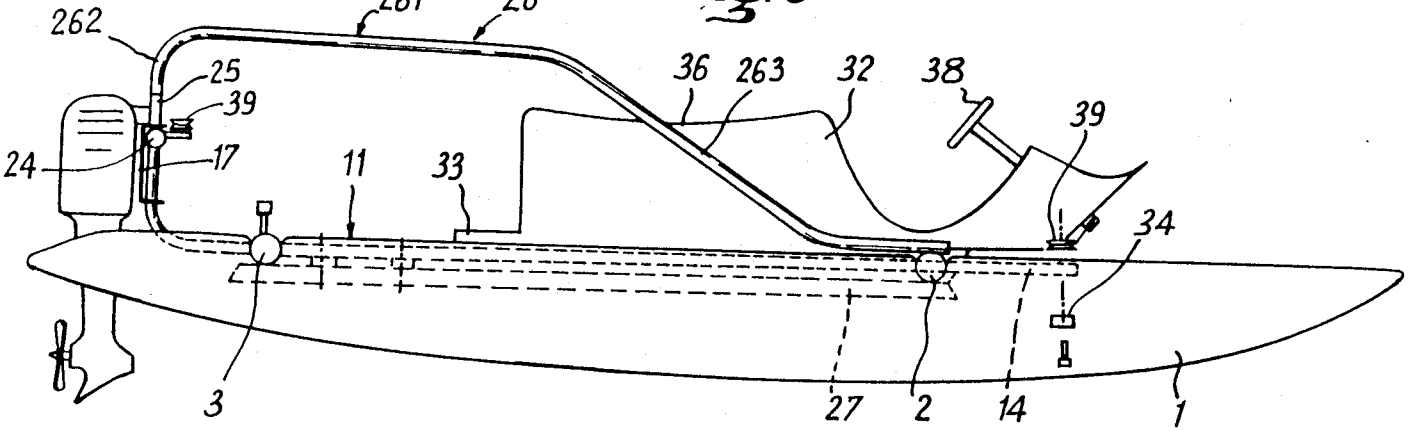
FIG. 6 is a view in elevation of the boat according to the invention mounted with its fairings.
Figure 7:
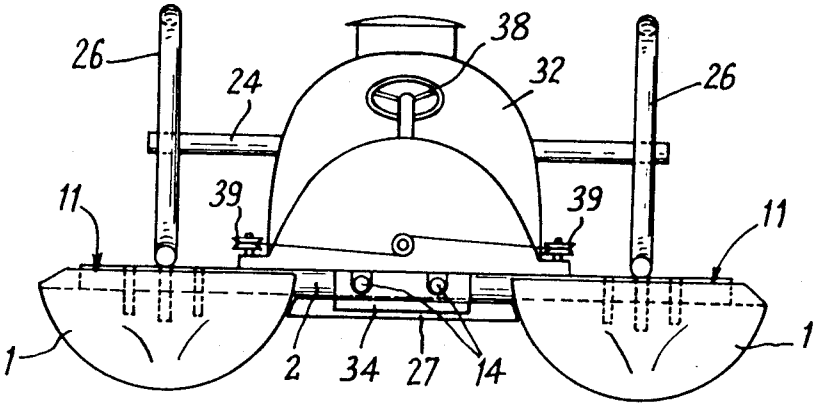
FIG. 7 is a front view of the boat shown in FIG. 6.

According to FIGS. 6 and 7, the hull of the floats 1 is preferably substantially semi-cylindrical inform, as is shown in conventional windsurfers, as opposed to the more traditional "V" sections in catamarans. This particular arrangement of the floats 1 reduces on the one hand the resistance to advance thanks to the resulting small draught and, on the other hand, the resistance to lateral thrusts in bends resulting from the centrifugal force which causes the boat to "skid", thus avoiding the catamarans capsizing.

Finally, this rounded form of the hulls of the floats accessorily allows landings without risk of deterioration, thus enabling this type of boat to be employed for all types of use.

I claim:

1. A boat of the catamaran type having an outboard motor for mechanically propelling thereof, two identical coplanar and parallel floats, and assembly means for maintaining a seat for the motor and the floats rigidly together; said assembly means comprising:

two transverse bars disposed perpendicularly to the axis of said floats, one of said transverse bars being a front transverse bar at the front of said floats and the other of said transverse bars being a rear transverse bar at the rear of the said floats, and means for maintaining said transverse bars fast with said floats and dismounting means including slots in said floats;

a central longitudinal member extending longitudinally between said two floats, for connecting said two transverse bars, at their centre, and dismountable fixing means for said central longitudinal member for blocking the transverse bar at the rear from rotation in order to support the seat of the motor;

two lateral bows fast with said seat and extending on either side thereof up to said front transverse bar and fixed thereto for absorbing efforts of acceleration and constituting a member for a passenger to hold; and lower and upper fairings completing the boat and providing a seating area to sit and control the boat.

2. The boat of the catamaran type according to claim 1, wherein said central longitudinal element includes means comprising at least one cylindrical bar traversing, at its centre and in sliding manner, the front transverse bar;

said front transverse bar being provided with at least one horizontal, diametral bore, and fitting on at least one stud for said rear transverse bar and fast therewith extending forwardly and perpendicularly thereto at its centre, in a horizontal plane.

3. The boat of the catamaran type according to claim 1, including a metal frame fixing said seat to said outboard motor to said rear transverse bar, above and level thereto in a vertical plane passing through its longitudinal axis, said metal frame being fixed on said rear transverse bar, and triangulated perpendicularly by arms joining lugs for fitting said central longitudinal element at the top of the seat.

4. The boat of the catamaran type according to claim 1, including:

bow means for said seat to fix an outboard motor to said rear transverse bar for rendering said outboard motor fast with said rear transverse bar above the latter and rearwardly offset with respect to said rear transverse bar said bow means coming in line with said central longitudinal element, the terminal part of said bow means being maintained fixed to said rear transverse bar and passing through said rear transverse bar at its centre to form a lug onto which said central longitudinal element is fitted; and two triangulation arms joining said rear transverse bar to the top of said seat for reinforcing said assembly.

5. The boat of the catamaran type according to claim 1, including:

lateral bows comprising a first horizontal intermediate section forming a holding rail;

a second vertical rear section fitted on either side of said seat; and a third front section, rounded, for providing elasticity to said bows, for absorbing the transitory longitudinal efforts, and clearing the seating zone to allow access thereto.

6. The boat of the catamaran type according to claim 1, wherein said lower fairing is made of a material identical to that of said floats, said lower fairing is a plate having a shape corresponding to the horizontal plane included between said two floats, laterally following their shapes and defined, at the front and at the rear of the boat, by said front and rear transverse bars beneath which said plate abuts, said plate being maintained by two counterplates tightening the central longitudinal element.

7. The boat of the catamaran type according to claim 1, wherein said upper fairing is made of a material identical to that of the floats, said material covering said two floats; and including:

means for fixing the two floats to said upper fairings;

a single, one-piece part comprising a seat element for a pilot to sit on; and a saddle element for a passenger, as well as arrangements for fixing members for steering and for controlling the motor.

8. The boat of the catamaran type according to claim 1, wherein the hulls of the floats have a substantially semicylindrical transverse section of the type employed in windsurfers for avoiding the risk of capsizing whilst reducing its draught.

9. The boat of the catamaran type according to claim 1, wherein said floats are made of a molded synthetic glass-fiber reinforced synthetic resin.

10. The boat of the catamaran type according to claim 1, wherein said lateral bows are fixed, at the rear, on lugs disposed vertically between the ends of an additional transverse bar fast with said seat and, at the front, by bolting at the ends of said front transverse bar level with centering studs, said centering studs having a vertical tapping for receiving bolts going through ends of said lateral bows.

11. A boat of the catamaran type having propelling means mounted thereon for mechanically propelling thereof, said boat comprising:

seat means for mounting said propelling means;

a pair of identical, coplanar and parallel floats, each of said floats having slot means; and assembly means for maintaining said seat means and said floats rigidly together, said assembly means comprising:

a pair of spaced, front and rear transverse bars disposed perpendicularly to the axis of said floats, said slot means receiving the ends of both said front and rear transverse bars, for dismountably connecting the ends of said front and rear transverse bars to said floats;

central longitudinal means extending longitudinally between said floats for rotationally and longitudinally reinforcing said front and rear transverse bars;

front transverse bar means for dismountably connecting said front transverse bar to said central longitudinal means and for blocking rotation therebetween;

rear transverse bar means for dismountably connecting said rear transverse bar to said central longitudinal means and for blocking rotation therebetween;

supporting means for supporting said seat means on said rear transverse bar;

reinforcement means, connecting said front transverse bar and said seat, for reinforcing said set means including a pair longitudinal bows extending on either side of said seat means up to said front transverse bar for absorbing the efforts of acceleration and to constitute a member for a passenger to hold; and a pair of lower and upper fairings connected to one another and completing said boat and including means for supporting said occupants in a sitting position and means for controlling the movement of said boat.

12. The boat according to claim 11, wherein said central longitudinal means comprises a pair of cylindrical tubes, said front transverse bar means comprises said front transverse bar having a pair of centrally located, horizontal, diametral bores configured to slidably receive said tubes, and said rear transverse bar means comprises a pair of studs centrally connected to said rear transverse bar, extending forwardly and perpendicularly to said rear transverse bar in a horizontal plane and configured to project into said tubes.

13. The boat according to claim 11, wherein said seat means is located above and level with said rear transverse bar in a vertical plane passing through a longitudinal axis of said rear transverse bar;

said central longitudinal means comprises a pair of cylindrical tubes located side by side, said rear transverse bar means comprises a pair of lugs, centrally connected to said rear transverse bar, extending forwardly and perpendicularly to said rear transverse bar in a horizontal plane and configured to project into said tubes;

said supporting means comprises a metal frame connecting said seat means to said rear transverse bar; and said assembly means further includes a pair of triangulation arms connecting said lugs to the top of said seat means for perpendicularly triangulating said metal frame.

14. The boat according to claim 11, wherein said seat means is located above said rear transverse bar and is rearwardly offset with respect to said rear transverse bar;

said supporting means comprises a pair of vertically oriented, curved bows connecting, at their upper ends, said seat means to said rear transverse bar;

said rear transverse bar means comprises a pair of lugs, formed in the lower ends of said curved bows, configured to project into said tubes; and said assembly means further includes a pair of triangulation arms joining said rear transverse bar to the top of said seat for reinforcement.

15. The boat according to claim 11, wherein each of said longitudinally extending bows comprises a first horizontal intermediate section that may accessorily be used as a holding rail, a second vertical rear section extending from one end of said intermediate section and on either of said sides of said seat and a third front section extending, from the other end of said intermediate section, to said front transverse bar, said third front section having a rounded configuration to provide elasticity to said longitudinally extending bows and to absorb the transitory longitudinally efforts while clearing said occupant supporting means of said fairings for access thereto.

16. The boat according to claim 11, wherein said lower fairing and said floats are made of the same material and comprises a plate having a shape corresponding to a horizontal plane defined between the two said floats, laterally following their shapes on either side, and between said front and rear transverse bars, said plate abutting said front and rear transverse bars below said front and rear transverse bars, and said assembly means further comprises a pair of counterplates and means, connecting said counterplates to said lower fairing, for tightening said counterplates against said longitudinal means.

17. The boat according to claim 11, wherein said occupant supporting and boat controlling means is integrally formed with said upper fairing as a one-piece part and include a seat element for seating a pilot, a saddle element for seating a passenger and means for steering and controlling said propelling means.

18. The boat according to claim 11, wherein the hulls of said floats have a substantially semi-cylindrical transverse cross section of the type employed in windsurfers for avoiding the risk of capsizing while reducing the draught of said floats.

19. The boat according to claim 11, wherein said floats are made of a moulded synthetic glass-fiber reinforced synthetic resin.

20. The boat according to claim 11, wherein each of said longitudinally extending bows has a tubular configuration, said slot means, for each end of a said transverse bar, comprises a said float having a slot defined in its top surface and a centering bore defined within said slot, each of the ends of said transverse bars further has a centering stud configured to project into a said centering bore when received within a said slot and a vertical tapping extending into said centering stud, said seat reinforcement means comprise a horizontal bar connected to said seat and a pair of vertically oriented studs connected to said horizontal bar, on either side of said seat, configured to project into said longitudinally extending bows, at one end thereof, and a pair of bolts projecting through said longitudinally extending bows, at the other end thereof, configured to be threaded into said vertical tappings.

* * * * *